US005392562A

United States Patent [19]

Carámbula

[11] Patent Number: 5,392,562

[45] Date of Patent: Feb. 28, 1995

[54] UNIVERSAL MOUNTING PLATE FOR DOOR OPENER

[75] Inventor: David E. Carámbula, Kalamazoo, Mich.

[73] Assignee: International Research and Development Corporation, Mattawan, Mich.

[21] Appl. No.: 149,639

[22] Filed: Nov. 9, 1993

[51] Int. Cl.[6] ..... E05F 11/24

[52] U.S. Cl. ..... 49/346; 49/139; 49/340; 248/300; 248/911

[58] Field of Search ..... 49/340, 324, 346, 139; 248/300, 674, 911, 254, 262, 269

[56] References Cited

U.S. PATENT DOCUMENTS

| | | | |
|---|---|---|---|
| 1,314,023 | 8/1919 | Spencer et al. | 49/346 |
| 1,938,818 | 12/1933 | Erickson et al. | 248/300 X |
| 3,406,936 | 10/1968 | Dirks | 248/300 X |
| 4,108,414 | 8/1978 | Grant, Sr. | 248/300 |
| 4,365,442 | 12/1982 | Speer | 49/346 |
| 4,660,324 | 4/1987 | Nyenbrink | 49/340 |
| 4,850,094 | 7/1989 | Lybecker | 49/340 X |
| 4,979,261 | 12/1990 | Lasier et al. | 49/324 X |

*Primary Examiner*—Philip C. Kannan
*Attorney, Agent, or Firm*—Gordon W. Hueschen

[57] ABSTRACT

A universally-adaptable mounting plate for mounting an electrically-operated door opener on a door frame. The mounting plate is substantially rectangular, having a plan portion with longitudinally-directed side edges and transversely-directed end edges. A tab is struck from the plan portion at one end of the mounting plate and is positioned substantially perpendicular to the plan portion and substantially equidistant from and substantially parallel with respect to the side edges. The plan portion is provided with both longitudinally-elongated and transversely-elongated apertures for mounting the door opener thereon, and the tab is provided with an aperture for receiving conventional fastening means for affixing the tab to a door frame or door frame jamb. A flattened Z-bracket is conveniently used in combination therewith and mounted transversely near the top edge of the inside of the door for effecting inward opening of the door by means of a conventional roller, rotatably mounted at the end of a door opener actuator arm, operating in rotating contact with the inside surface of the outer upstanding wall of the Z-bracket.

5 Claims, 3 Drawing Sheets

UNIVERSAL MOUNTING PLATE FOR DOOR OPENER

BACKGROUND OF THE INVENTION

1. Field of the Invention

The present invention relates to apparatus for opening doors, and more particularly refers to a plate for mounting electrically-operated door openers.

2. Description of the Prior Art

Electrically-operated door openers are widely used in hospitals and nursing homes and other public buildings where the elderly and partially incapacitated individuals occasionally find it necessary to open doors to gain entrance or to exit. Generally such doors utilize spring-loaded or pneumatically-loaded door closers to maintain the doors in normally-closed condition. It is difficult for weak or incapacitated people, or people entering in a wheel chair, to overcome the force of a door closer in order to open the door. It has consequently become a universal necessity to provide some doors with electrically-operated door openers to overcome the force exerted by door closers utilized to maintain the doors closed, or even the mass of the door itself, and to permit such weak or incapacitated individuals to gain access to, or to exit readily from, the building.

Electrically-operated door openers of the type described are available in the marketplace. However, because there is a large difference in door frames and ceiling heights, it has been conventional to provide a mounting plate upon which to mount the door opener, which mounting plate is designed to take Care of one or more but only some of such variations. One such mounting plate is shown and described hereinafter. Although this mounting plate is adapted to take care of a few differences in door frame and ceiling structure, it is not sufficiently versatile to take care of all situations which may be encountered. Moreover, the prior art mounting plate must be made very large in order to handle both normal and inverted mounting requirements.

OBJECTS OF THE INVENTION

It is an object of the invention to provide a mounting plate for a door opener which is relatively simple in structure.

It is a prime object of the invention to provide a mounting plate for a door Opener which is universal in its application to mount the door opener under a large variety of conditions which may be encountered with regard to variations in size, shape, and positioning of door frames, and with regard to the relationship of door frames to ceilings and walls.

It is still further an object to provide a mounting plate for a door opener of the type described which has low material and fabrication costs.

The foregoing and other objects, advantages, and characterizing features will become apparent from the following description and drawings of certain illustrative embodiments of the invention.

THE INVENTION

According to the invention, a mounting plate for mounting a door opener on a door frame is provided having a plurality of apertures for mounting on a door frame and for having a door opener affixed thereto. The mounting plate is also provided with a tab at one end extending transversely with respect to the surface of the plate and equidistant from and parallel with respect to the side edges of the plate. An aperture is provided in the tab for receiving fastening means for affixing the tab to the door jamb. The plate may thus be mounted in any of a large number of positions and is more versatile in that respect than any plate disclosed in the art.

SUMMARY OF THE INVENTION

The invention, then, comprises the following, inter alia, singly or in combination:

A substantially rectangular mounting plate for mounting an electrically-operated door opener on a door frame, said mounting plate comprising: a plan portion having top and bottom faces, substantially parallel longitudinally oriented side edges one of which is shorter than the other, and substantially parallel transversely oriented end edges, a tab oriented substantially perpendicular to said plan portion, said tab being substantially parallel to and substantially equidistant from said longer side edge and a theoretical extension of said shorter side edge, and a plurality of apertures provided in said plan portion, and an aperture provided in said tab, said apertures being provided for receiving fastening means for fastening said mounting plate to a door frame and to a door opener which is to be mounted thereon; such a mounting plate, wherein some of said apertures provided in said plan portion are elongated in a longitudinal direction, and other of said apertures are elongated in a transverse direction, whereby door openers of diverse dimensions may be mounted thereon; such a mounting plate, wherein said tab is integral with said plan portion, and is formed by making a transverse cut in spaced apart relationship with respect to one of said transverse edges to a point substantially equidistant from said longitudinal edges, and bending the cut portion until it is oriented essentially perpendicular with respect to said plan portion; such a mounting plate, in combination with a bracket having a flattened-Z cross-section adapted to be mounted transversely on an inside top section of a door, near the top edge thereof, with an outer wall of the Z being upstanding, for use in combination with a door opener having an actuating arm carrying a rotatably-mounted roller for rotating contact of said roller with the inside surface of said outer upstanding wall of the Z-shaped bracket, to enable the door with which utilized to be opened inwardly and also, such a combination of a door opener, mounting plate, and Z-bracket.

DESCRIPTION OF THE PREFERRED EMBODIMENTS

Figure 1:
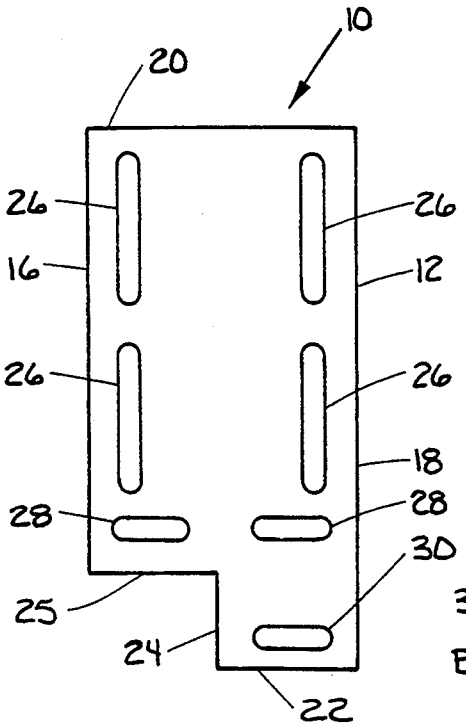
FIG. 1 is a plan view of a mounting plate according to the invention.
Figure 2:
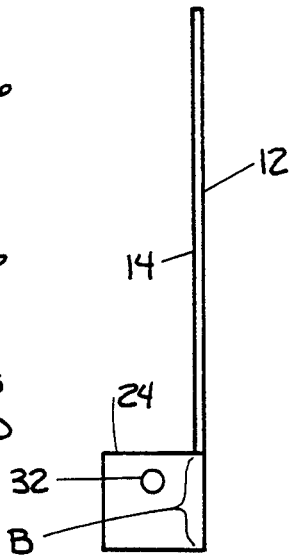
FIG. 2 is an edge view, of the mounting plate shown in FIG. 1.
Figure 3:
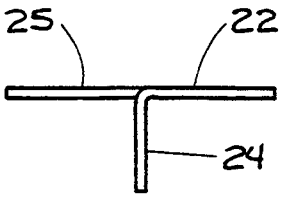
FIG. 3 is an end view of the lower end of the mounting plate shown in FIGS. 1 and 2.

Referring to FIGS. 1–3, an elongated rectangular mounting plate 10 is shown, having a plan portion including a top face 12 and a bottom face 14. The mounting plate 10 has a short longitudinal edge 16, a long longitudinal edge 18, a long transverse or end edge 20, and a short transverse or end edge 22. A right angle tab 24 is formed by making a transverse cut at the edge 25 and bending the tab 24 until it is disposed at substantially a right angle with respect to the plan portion of the mounting plate 10. The tab 24 is positioned substantially equidistant from a theoretical extension of the longitudinal edge 16 and from the longitudinal edge 18. The base B of the tab 24 is oriented substantially parallel with respect to the long longitudinal edge 18.

A plurality of longitudinally-elongated apertures or slots 26 are provided in the mounting plate 10 for mounting a door opener thereon. A plurality of transversely-elongated apertures or slots 28 and 30 are provided in the plate for mounting on a door frame in some applications. An aperture 32 is provided in the tab 24 for receiving a fastening means to fasten the tab 24 to the door frame or door frame jamb.

Figure 4:
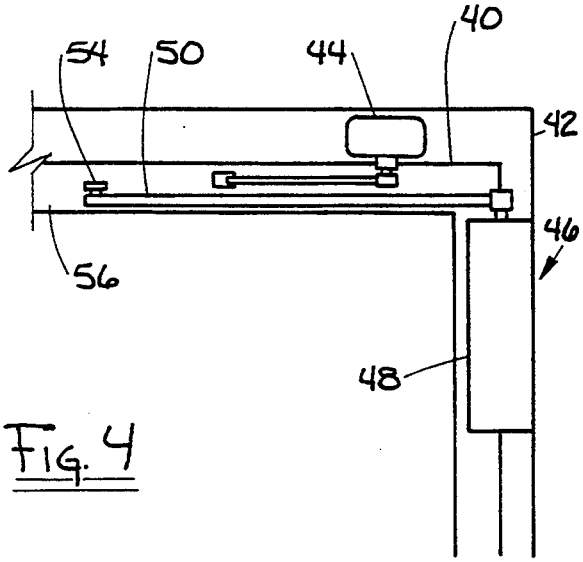
FIG. 4 is a fragmentary plan view of a corner of a door frame showing both a door closer and a door opener mounted thereon in inverted position.

Referring to FIG. 4, a portion of a door frame 40 is shown, having a right vertical frame member 42. A door closer 44 is mounted on the frame and a door opener 46, having a motor and electronic control 48, is mounted on a mounting plate, not shown. An actuator arm 50 is connected to the door opener 46, and operates by means of a roller 54 rotatably-mounted thereon and rotatably exerting force against the inner surface of the door 56. The door opener 46 is mounted on the door frame 40 in inverted position, the least desirable position unless the presence of a low ceiling dictates such a position.

Figure 5:
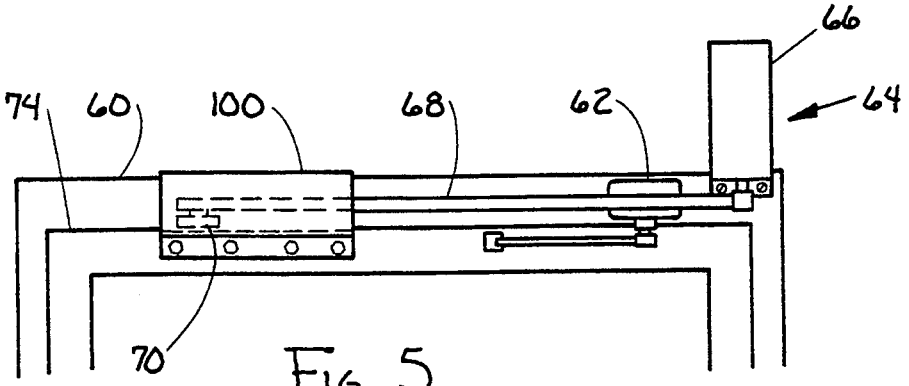
FIG. 5 is a fragmentary elevational view of the upper portion of a door frame, with a door closer mounted thereon, and with a door opener mounted thereon in the desired normal position, but with an arrangement provided for causing the door to open inwardly.

Referring to FIG. 5, the upper portion of a door frame 60 is shown, having a door closer 62 mounted thereon. A door opener 64 is mounted on a mounting plate 10 of the invention, not shown, in the desired normal position, that is, above the door frame. The door opener 64 comprises a motor and electronic control unit 66. The door opener 64 additionally comprises an actuator arm 68 carrying a rotatably-mounted roller 70. A Z-bracket 100, having a flattened-Z cross section

Figure 14:
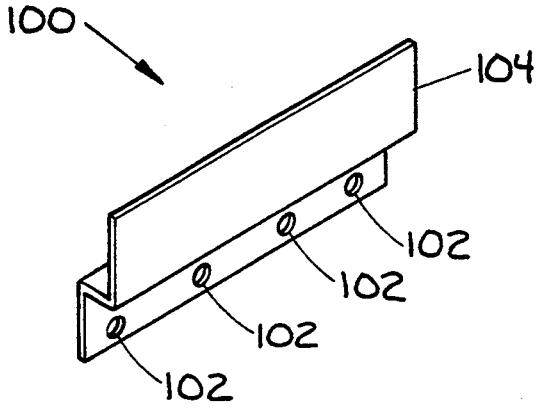
FIG. 14 is a perspective view of a Z-bracket utilized as an accessory of the mounting plate of the present invention to provide for the opening of a door inwardly.

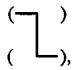

as shown in FIG. 14, is mounted transversely on the inside of door 74 near the top edge thereof, and the inside surface of the outer upstanding wall 104 of the Z-bracket 100 (See FIGS. 14 and 15) is rollingly-engaged and forced inwardly by the roller 70. Such arrangement is of course conveniently utilized when it is desired that the door be opened inwardly.

Figure 6:
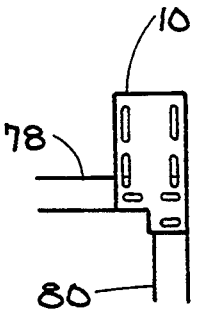
FIG. 6 is a fragmentary elevational view of the right corner of a door frame with the mounting plate of the invention mounted in normal position on the inner edge of the right door frame.
Figure 7:
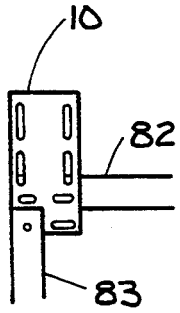
FIG. 7 is a fragmentary elevational view of the left corner of a door frame with the mounting plate of the invention mounted in normal position on the inner edge of the left door frame.
Figure 8:
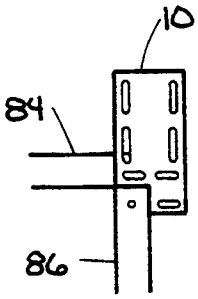
FIG. 8 is a fragmentary elevational view of the right corner of a door frame with the mounting plate of the invention mounted in normal position on the outer edge of the right door frame.
Figure 9:
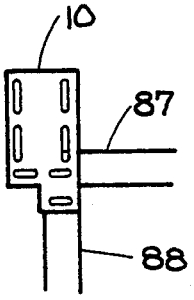
FIG. 9 is a fragmentary elevational view of the left corner of a door frame with the mounting plate of the invention mounted in normal position on the outer edge of the left door frame.
Figure 10:
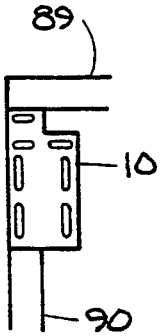
FIG. 10 is a fragmentary elevational view of the left corner of a door frame with the mounting plate of the invention mounted in inverted position on the inner edge of the left door frame.
Figure 11:
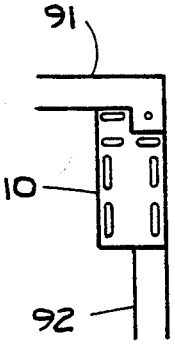
FIG. 11 is a fragmentary elevational view of the right corner of a door frame with the mounting plate of the invention mounted in inverted position on the inner edge of the right door frame.
Figure 12:
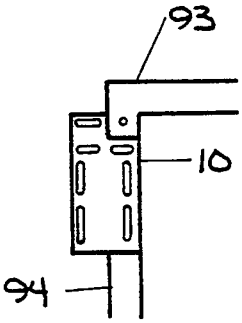
FIG. 12 is a fragmentary elevational view of the left corner of a door frame with the mounting plate of the invention mounted in inverted position on the outer edge of the left door frame.
Figure 13:
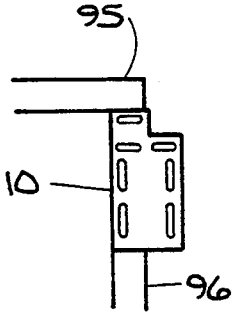
FIG. 13 is a fragmentary elevational view of the right corner of a door frame with the mounting plate of the invention mounted in inverted position on the outer edge of the right door frame.

Referring to FIGS. 6–13, views are shown of the various ways that the mounting plate 10 may be mounted on various door frames, with the tab 24 on the inside or on the outside of the door frame, thus demonstrating the universality of the present mounting plate. In FIG. 6 the mounting plate is mounted on a door frame 78 in normal position with tab 24 secured to the jamb inside the right vertical frame member 80. In FIG. 7 the mounting plate 10 is mounted on a door frame 82 in normal position with tab 24 secured to the jamb inside the left vertical frame member 83. In FIG. 8 the mounting plate 10 is mounted on a door frame 84 in normal position with tab 24 secured to the outside of right vertical frame member 86. In FIG. 9 the mounting plate 10 is mounted on a door frame 87 in normal position with tab 24 secured to the outside of left vertical frame member 88. In FIG. 10 the mounting plate 10 is mounted on a door frame 89 in inverted position with tab 24 secured to the jamb inside the left vertical frame member 90. In FIG. 11 the mounting plate 10 is mounted on a door frame 91 in inverted position with tab 24 secured to the jamb inside the right vertical frame member 92. In FIG. 12 the mounting plate 10 is mounted on a door frame 93 in inverted position with tab 24 secured to the outside of left vertical frame member 94. In FIG. 13 the mounting plate 10 is mounted on a door frame 95 in inverted position with tab 24 secured to the outside of right vertical frame member 96. This illustrates the universality of the present mounting plate 10.

Figure 15:
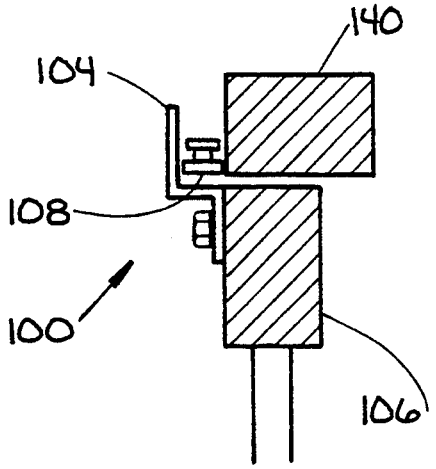
FIG. 15 PRIOR ART
FIG. 15 is a fragmentary cross-sectional view of the Z-bracket shown in FIG. 14, mounted on a door, with necessary associated members and elements for inward door opening.

Referring to FIGS. 14 and 15, a Z-bracket 100 is shown having a plurality of apertures 102 provided for mounting the bracket on a door on the inside near the top transverse edge thereof. In FIG. 15 the Z-bracket 100 is shown mounted transversely on the inside top portion of door 106 below door frame 140. A roller 108 from the actuating arm of a door opener is also shown. The roller 108, rotatably secured to the actuating arm, makes rollable or rotating contact with the inside surface of an outer upstanding wall 104 of the Z-bracket. The Z-bracket is thus used as an accessory to the mounting plate 10 when it is desired that the door open inwardly instead of outwardly, as further shown in FIG. 5.

Figure 16:
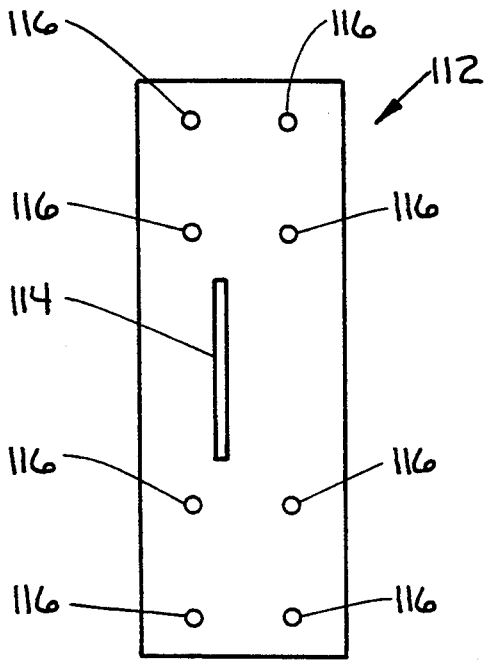
FIG. 16 is a plan view of a prior art mounting plate utilized for mounting a door opener.
Figure 17:
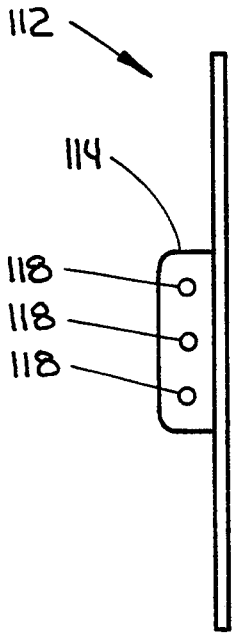
FIG. 17 is a side edge view of the mounting plate shown in FIG. 16.

Referring to FIGS. 16 and 17, a mounting plate 112 as disclosed in the prior art is shown. The mounting plate 112 is provided with a flange 114 for being affixed to the door jamb. A plurality of apertures 116 are provided in the plate 112 for mounting the plate on a door frame and for mounting a door opener on the plate. The mounting plate has two sets of apertures 116 so that the plate can be mounted in either normal or inverted position on the door frame. Apertures 118 are also provided in the flange 114 so that the flange 114 can be affixed to the jamb by fastening means such as screws. Because the mounting plate 112 can not be rotated to be adapted for both normal and inverted mounting, it necessarily requires two sets of mounting apertures, and must necessarily be fabricated in a size twice as large and heavy as the mounting plate 10 of the present invention.

Prior to installing a door opener together with the mounting plate of the invention, it is necessary to check the force exerted by the door closer conventionally used with power-operated door openers to ascertain that the force exerted by the door closer is no greater than about 15 pounds. Conventional door openers will not overcome a door-closer force of over 15 pounds. If the force is greater, it may be necessary to reduce the force of the door closer.

In preparing to mount the door opener, the mounting plate 10 is first mounted on the door frame in any of the positions shown in FIGS. 6–13. A screw is then inserted through the aperture 32 and screwed into the door jamb. Additionally, screws may be inserted into the slots 28 and 30 and screwed into the face of the vertical frame member. The door opener 46 or 64 may then be mounted with screws or bolts inserted through the slots 26.

After installation, When a switch is actuated, the actuator arm 50 or 68 pushes the door open against the force of the door closer 44 or 62. When the automatic circuit of the door opener removes electrical current from the door opener, the door closer then closes the door.

The mounting plate 10 of the present invention has many advantages over mounting plates of the prior art exemplified by the mounting plate 112 shown in FIGS. 16 and 17. The disadvantages of the prior art mounting plate are as follows:

1. The prior art mounting plate must be more than twice as large and heavy as the present mounting plate, since the prior art mounting plate 112 is not reversible for mounting in either normal or inverted position.
2. The prior art mounting plate can be mounted normally only when the door opener can be positioned above the door edge, that is, when there is a sufficiently high ceiling. It can be mounted in inverted position only when there is a transom above the door frame.
3. The prior art mounting plate requires two sets of mounting apertures since it is not reversible.
4. The prior art mounting plate cannot be mounted on the outside of the door frame.
5. The prior art mounting frame cannot be mounted to permit the door to open inwardly.

The present mounting plate has the following advantages:

1. The present mounting plate is less than half the size of the prior art plate, since the tab for being attached to the door edge is centrally located at one end of the plate, and the entire plate can be rotated to be mounted in either normal or inverted position.
2. The present mounting plate can be mounted in either normal or inverted position, even when there is no transom over the door frame.
3. The present mounting plate may be readily mounted on either the right or left side of the door frame, since the perpendicular mounting tab for affixing to the door jamb edge is centrally located.
4. The present mounting plate may be mounted either above the door frame, or below the door frame when there is insufficient ceiling clearance.
5. The present mounting plate may be mounted either on the inside or outside of the door frame by means of the centrally positioned tab.
6. The present mounting plate may be mounted for the door to be opened inwardly instead of outwardly by the addition of the accessory "Z" bracket.
7. The mounting apertures of the present mounting plate are elongated to permit adjustment of the position of the plate and the mounting of the door opener thereon.

Although the invention has been described in connection with specific embodiments thereof, it is evident that many alternatives, modifications, and variations will be apparent to those skilled in the art in the light of the foregoing description and appended drawings. Accordingly, it is intended to embrace all such alternatives, modifications, and variations within the spirit and scope of the invention as defined by the following claims.

I claim:

1. A substantially rectangular mounting plate for mounting an electrically-operated door opener on a door frame, said mounting plate comprising:

a plan portion having top and bottom faces, substantially parallel longitudinally oriented side edges one of which is shorter than the other, and substantially parallel transversely oriented end edges, a tab oriented substantially perpendicular to said plan portion, said tab being substantially parallel to and substantially equidistant from said longer side edge and a theoretical extension of said shorter side edge, and a plurality of apertures provided in said plan portion, and an aperture provided in said tab, said apertures being provided for receiving fastening means for fastening said mounting plate to a door frame and to a door opener which is to be mounted thereon.

2. A mounting plate according to claim 1, wherein some of said apertures provided in said plan portion are elongated in a longitudinal direction, and other of said apertures are elongated in a transverse direction, whereby door openers of diverse dimensions may be mounted thereon.

3. A mounting plate according to claim 1, wherein said tab is integral with said plan portion, and is formed by making a transverse cut in spaced apart relationship with respect to one of said transverse edges to a point substantially equidistant from said longitudinal edges, and bending the cut portion until it is oriented essentially perpendicular with respect to said plan portion.

4. A door-opener mounting kit comprising the following elements:

1: a substantially rectangular mounting plate for mounting an electrically-operated door opener on a door frame, said mounting plate comprising:

a plan portion having top and bottom faces, substantially parallel longitudinally oriented side edges one of which is shorter than the other, and substantially parallel transversely oriented end edges, a tab oriented substantially perpendicular to said plan portion, said tab being substantially parallel to and substantially equidistant from said longer side edge and a theoretical extension of said shorter side edge, and a plurality of apertures provided in said plan portion, and an aperture provided in said tab, said apertures being provided for receiving fastening means for fastening said mounting plate to a door frame and to a door opener which is to be mounted thereon, 2: an inwardly-opening door opener adapted to be mounted on said mounting plate, and 3: a Z-bracket having a flattened-Z cross-section adapted to be mounted transversely on an inside top section of a door, near the top edge thereof, with an outer wall of the Z being upstanding, said door opener (2) having an actuating arm carrying a rotatably-mounted roller and adapted to be arranged with said roller in rotating contact with the inside surface of said outer upstanding wall of said Z-shaped bracket (3), these elements when assembled into a combination being adapted to enable a door with which utilized to be opened inwardly by engagement of said roller with the said inside surface of said outer upstanding wall of said Z-shaped bracket.

5. A combination of

1: a substantially rectangular mounting plate secured on a door frame, said mounting plate comprising:

a plan portion having top and bottom faces, substantially parallel longitudinally oriented side edges one of which is shorter than the other, and substantially parallel transversely oriented end edges, a tab oriented substantially perpendicular to said plan portion, said tab being substantially parallel to and substantially equidistant from said longer side edge and a theoretical extension of said shorter side edge, and a plurality of apertures provided in said plan portion, and an aperture provided in said tab, selected apertures receiving fastening means securing said mounting plate to the door frame and to a door opener which is mounted thereon, 2: an inwardly-opening electrically-operated door opener mounted on said mounting plate, and 3: a Z-bracket having a flattened-Z cross-section mounted transversely on an inside top section of a door mounted in said door frame, near the top edge of said door, with an outer wall of the Z being upstanding, said door opener (2) having an actuating arm carrying a rotatably-mounted roller and being arranged with said roller in rotating contact with the inside surface of said outer upstanding wall of said Z-shaped bracket (3), this combination enabling the said door to be opened inwardly by engagement of said roller with the said inside surface of said outer upstanding wall of said Z-shaped bracket.

* * * * *